United States Patent [19]

Lambert

[11] 4,254,530

[45] Mar. 10, 1981

[54] CLEANING AND WASHING PAD

[75] Inventor: Ralph G. Lambert, Methuen, Mass.

[73] Assignee: Drutan Products, Inc., Haverhill, Mass.

[21] Appl. No.: 93,838

[22] Filed: Nov. 13, 1979

[51] Int. Cl.[3] ..... A47L 13/38

[52] U.S. Cl. ..... 15/235; 15/118; 112/262.1; 428/71; 428/188; 428/192; 428/193; 428/247; 428/253; 428/255; 428/310; 428/473; 428/311

[58] Field of Search ..... 428/310, 102, 188, 192, 428/193, 247, 252, 253, 255, 311, 194, 71, 473, 311; 15/118, 235; 112/441, 262.1

[56] References Cited

U.S. PATENT DOCUMENTS

| | | | |
|---|---|---|---|
| 1,398,772 | 11/1921 | Anderson | 15/235 |
| 1,521,983 | 1/1925 | Barker et al. | 15/235 |
| 2,124,061 | 7/1938 | Gould | 15/235 |
| 2,943,339 | 7/1960 | Vosbrkian et al. | 15/235 |
| 3,556,918 | 1/1971 | Lamelson | 15/118 |
| 3,629,896 | 12/1971 | Sirnec | 15/118 |
| 3,801,420 | 4/1974 | Anderson | 428/194 |
| 3,861,993 | 1/1975 | Guthrie | 15/118 |
| 4,130,683 | 12/1978 | Michel et al. | 428/194 |

*Primary Examiner*—James J. Bell

*Attorney, Agent, or Firm*—Richard P. Crowley

[57] ABSTRACT

An improved cleaning-and washing-pad material, which pad material comprises in combination: a soft natural or synthetic shearling sheet material forming one surface of the pad material and a tough, nylon-mesh material forming the other surface of the pad, the shearling material and the nylon material sewed together about the peripheral edges to form a cavity therein; and a soft, resilient, substantially open-cell, polyurethane or cellulose sponge material loosely inserted within the hollow cavity to provide body and bulk to the pad, whereby the improved cleaning- and washing-pad material presents a soft water-absorbent surface for washing and a tough scrubbing surface for cleaning purposes.

16 Claims, 3 Drawing Figures

CLEANING AND WASHING PAD

BACKGROUND OF THE INVENTION

The cleaning and washing of surfaces to remove dirt, grease, dust, bird droppings and the like from a hard surface, such as an automobile surface, typically require the use of various types of different washing and cleaning surfaces. Often a very soft cotton-type cloth is employed to apply soap or detergent in water to the surface and to remove loosely attached surface dirt, or a natural sponge material may be used to apply the water and soap to the surface. The removal of hard-to-remove dirt from an automobile surface typically requires the use of a hard brush or a much harder fabric-type material.

In addition, it is often desirable, in connection with the use of scrubbing, washing and cleaning materials, to provide sufficient bulk by providing sufficient material to enable the user to grasp readily the material in use. Therefore, it is desirable to provide for a simple and improved cleaning-, scrubbing- and washing-pad material which provides for different surfaces for different functions and, in addition, provides for a bulky material which is adapted to contain a reservoir of water, particularly water with soap or detergent therein. Such an improved pad material should be simply constructed and easily made at low cost and should utilize readily available materials. Such an improved pad material may be employed to wash, clean and scrub, with a minimum of ease and high efficiency, a variety of surfaces, including, for example, automobile surfaces, without damaging the surfaces, but yet providing greater efficiency than in employing a variety of materials, as previously employed, to clean, wash and scrub surfaces.

SUMMARY OF THE INVENTION

My invention relates to an improved washing- and cleaning-pad material and to a method of manufacturing and using the material. In particular, my invention relates to an improved washing- cleaning- and scrubbing-pad material, which material is characterized by having a soft water-absorbing face, an opposite face composed of a tough synthetic fiber material to remove hard-to-remove dirt and containing within and between the soft and woven material a cellular material to provide bulk and/or a reservoir of water to be employed when cleaning and washing.

I have found that an improved cleaning-, washing- and scrubbing-pad material may be prepared by utilizing a certain combination of unique materials typically in flat and generally pad form, wherein the pad comprises a soft, shearling-type sheet material forming one surface of the pad, such as a natural shearling or a synthetic shearling material, and a tough, synthetic, open-mesh, fibrous material forming the other surface of the pad. Intermediate the two surfaces, the incorporation of a cellular material is desirable in providing bulk and body to the pad material, so that the user may readily grasp and use the pad material.

In addition, I also have found it desirable to employ a cellular material which is open-cellular in nature and is soft and resilient in properties, so that the cellular material will be water-absorbable and thus in use provide a reservoir of water during the washing or scrubbing cycle. The improved pad material, therefore, provides the user, in one single pad, with a soft water-absorbing surface for washing a surface and applying soap and water and an opposite surface which presents a tough fibrous surface adapted for scrubbing and the removal of difficult-to-remove objects from the surface to be washed.

Typically, my improved pad material may comprise a variety of forms and shapes, but more generally a substantially flat pad-like material presenting opposite washing and scrubbing surfaces, with the surfaces typically being of sufficient size to be used by an ordinary person, for example, for washing an automobile or for washing pots and pans, and thus may range from as low a 2 square inches to about 3 square feet or more, and typically may range in height from about ½ inch to 2 inches or more at the center of the pad material. The pad material generally is in round, square or rectangular form, although other shapes can be used and adopted. My improved pad material may be employed for a variety of washing, cleaning and scrubbing purposes where it is desirable to have a material soft on one side and hard on the other side.

My improved pad material comprises on one surface thereof a natural or synthetic shearling material. The shearling material, referred to in the natural product, is a skin of a sheep or lamb which has been tanned with the wool thereon and, therefore, presents a fluffy, soft wool surface. In addition, if desired, a synthetic shearling sheet material may be employed which often comprises a woven or knitted sheet material which has a man-made wool-like fibrous face adapted to look and have the characteristics, or at least some of the characteristics, of a natural shearling material.

The scrubbing surface of my improved pad material comprises a synthetic fiber, open-mesh material which is adapted to provide for the removal by scrubbing of hard-to-remove dirt, without damage to the surface to be washed. Typically and preferably, my material comprises a knitted or woven, nylon-type material in sheet form. Other synthetic fibrous materials may also be employed as desired, or combinations thereof, with natural and synthetic materials; although the preferred surface is an all-synthetic, woven fibrous material composed of nylon or other tough fibrous materials, such as polyesters and similar materials.

The shearling material and the woven fibrous material are formed together in a pad by securing together the peripheral edges of the materials of the same size to form a pouch, and later, after the insertion of a cellular material within the pouch, the other end of the pouch also is secured, so that the cellular material is totally enclosed within the pad. Optionally and if desired, other materials may be secured within the hollow cavity formed by the pouch and even within the foam, such as the use of soaps or detergents in solid form within the foam.

The peripheral edges of the shearling and woven materials may be secured together in a variety of ways, such as by the use of sewing, adhesing, heat-sealing of the like, but preferably is accomplished by sewing, due to the different natures of the shearling material and the tough, mesh material. In the event that adhesive materials are used, the adhesive materials should be nonwater-insoluble adhesive materials.

The cellular material employed within the pad and between the shearling material and the woven material may comprise a variety of cellular materials, such as, for example, synthetic or natural materials, but typically comprises a substantially open-cell cellular material which is soft and resilient in nature and adapted to hold or contain water therein, so as, if desired, to provide a water reservoir for use during the cleaning and scrubbing operation, as well as to provide for body or bulk, so that the user may grasp easily the material in his hand. The preferred material for use as the cellular material comprises a open-cell, polyurethane or polyvinyl-chloride, natural cellular or sponge-rubber-type cellular material. The cellular material may vary in foam density; for example, from 3 pounds to 50 pounds per cubic foot, and, since it is protected within the interior of the pad by its two outer surface coverings and is not subject to direct contact with the washed surface, the cellular material may be of a very soft and resilient nature.

The method of manufacturing my pad material is quite simple in that pieces of shearling and woven materials are cut to the desired size; for example, 6×8 inches, and then are secured together about three sides by sewing, and, thereafter, a flat, rectangular piece of open-cell urethane foam, such as of 5×7 inches size, substantially filling the pouch, is inserted into the open end and into the material and the other end sewed together or otherwise secured.

My invention will be described for the purpose of illustration only in connection with its preferred embodiment, and various changes and modifications may be made to the invention by a person skilled in the art, without departing from the spirit and scope thereof.

DESCRIPTION OF THE PREFERRED EMBODIMENTS

Figure 1:
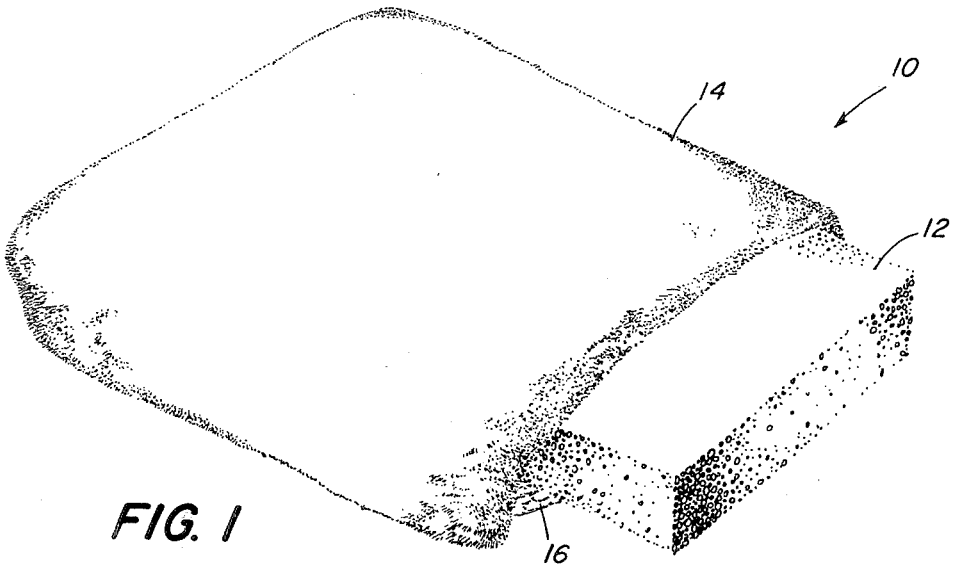
FIG. 1 is an illustrated perspective view showing the insert of the cellular sheet into the open pouch of the pad material during manufacture.

With reference to each of the figures, my improved washing and cleaning pad 10 as shown comprises a natural shearling material 14 and a tough, knitted, nylon-mesh sheet material 16, the peripheral edges of which have been secured together by sewing through a thread 18, to form an open-pouch material, with one end open, so that an open-cell, polyurethane cellular material 12 may be inserted into the open end of the pouch and positioned loosely within the pouch and substantially filling the hollow cavity therein, as illustrated in FIG. 1.

Figure 2:
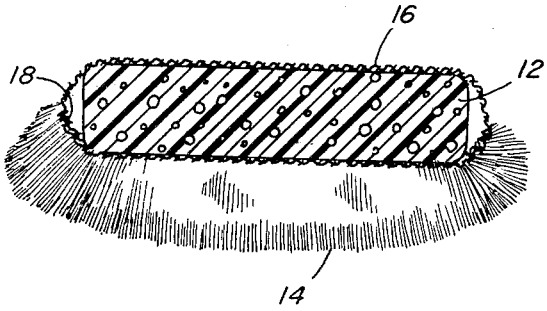
FIG. 2 is a cross-sectional view of the pad with the cellular sheet inserted.

FIG. 2 illustrates a cross-sectional view of the loose position of the sponge 12 within the pad material 10 showing a shearling surface 14 and a nylon-mesh sheet 16.

Figure 3:
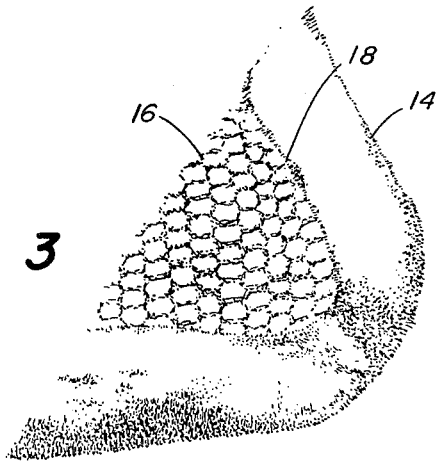
FIG. 3 is a top sectional view showing the fibrous surface of the pad material.

FIG. 3 shows in more detail the scrubbing surface formed of the nylon-mesh material 16.

My pad material may be employed by immersing in water containing soap or detergent and then applying a soft shearling surface 14 to the surface to be washed to remove loose dirt and, during the washing process, periodically reversing the pad 10 to use the scrubbing surface 16 to remove hard-to-remove dirt particles. The cellular material 12 contains water therein, and, since water will pass through the nylon-mesh material, permits the user to grasp readily the pad material. Of course, if desired, only one surface may be used; for example, the shearling surface 14 to absorb or to remove water or the nylon surface to remove dirt.

What is claimed is:

1. A cleaning-pad material, which pad material comprises in combination:

(a) a soft natural or synthetic shearling material, having a fluffy, water-absorbing surface, forming one surface of the pad;

(b) a tough, synthetic, mesh material forming the other surface of the pad;

(c) the shearling material and the mesh material secured together about the peripheral edges of the shearling and mesh material to form a pad with an open end and a hollow cavity therein; and (d) a soft, resilient, cellular material comprising an open-cell, water-absorbing, foam material positioned within and substantially filling the hollow cavity to provide bulk and body to the pad, whereby the pad material presents a soft, water-absorbing, shearling surface for washing, and the mesh material presents a tough scrubbing surface for the removal of difficult-to-remove objects from a washing surface.

2. The pad material of claim 1 wherein the cellular material is a substantially open-cell, cellular material adapted to receive and to contain water therein.

3. The pad material of claim 1 wherein the cellular material comprises an open-cell, polyurethane foam material.

4. The pad material of claim 3 wherein the cellular material is positioned unsecured within the hollow cavity.

5. The pad material of claim 1 wherein the mesh material comprises a knitted, nylon, fabric material.

6. The pad material of claim 1 wherein the shearling material and the mesh material are secured by threads about the peripheral edges.

7. The pad material of claim 1 wherein the shearling material and the mesh material are secured by a water-insoluble adhesive about the peripheral edges.

8. The pad material of claim 1 wherein the pad has a surface area of about 2 square inches to 3 square feet or more and a height at its center of from about ½ inch to 2 inches or more.

9. A cleaning-pad material, which pad material comprises in combination:

(a) a soft natural or synthetic shearling material, having a fluffy, water-absorbing surface, forming one surface of the pad;

(b) a tough, knitted, synthetic, nylon-mesh material forming the other surface of the pad;

(c) the shearling and the mesh material secured together by threads about all the peripheral edges of the shearling and mesh materials to form a hollow cavity therein;

(d) a soft, resilient, cellular material, comprising an open-cell-, water-absorbing polyurethane foam material, positioned unsecured within and substantially filling the hollow cavity to provide bulk and body to the pad, whereby the pad material presents a soft, water-absorbing, shearling surface for washing, and the mesh material presents a tough scrubbing surface for the removal of difficult-to-remove objects from a washing surface.

10. The pad material of claim 1 wherein the open end of the pad material is secured along its peripheral edges to enclose fully the cellular material within the pad formed by the shearling and mesh material.

11. A method of manufacturing a pad material for washing and cleaning surfaces, which method comprises:

(a) securing together the peripheral edges of a natural or synthetic shearling material of predetermined size and a knitted, synthetic, fiber material to form a pouch-like container with one open end; and (b) inserting in the open end of the pouch-like container a soft, resilient, cellular sheet material to provide body to the pouch-like container.

12. The method of claim 11 which comprises securing the peripheral edges by sewing the material.

13. The method of claim 11 wherein the cellular material comprises an open-cell, polyurethane cellular material.

14. The method of claim 11 wherein the knitted material comprises a nylon material.

15. The method of claim 11 which includes securing the open end of the pouch-like container to form a cleaning- and washing-pad material.

16. The method of claim 15 which includes securing the peripheral edges of the open end of the container by sewing.

* * * * *